US007435185B1

(12) United States Patent
Butler

(10) Patent No.: US 7,435,185 B1
(45) Date of Patent: Oct. 14, 2008

(54) ADJUSTABLE LENGTH BELLY PUTTER

(76) Inventor: William B. Butler, 40 Trout Farm La., Duxbury, MA (US) 02332

( * ) Notice: Subject to any disclaimer, the term of this patent is extended or adjusted under 35 U.S.C. 154(b) by 116 days.

(21) Appl. No.: 11/637,442

(22) Filed: Dec. 11, 2006

(51) Int. Cl.
*A63B 53/16* (2006.01)

(52) U.S. Cl. ..... 473/239; 473/296; 403/109.4

(58) Field of Classification Search ..... 473/290, 473/294, 296–299, 288, 307, 239; 403/109.4, 403/110, 379.3, 261–262, 109.6, 109.1, 109.5, 403/378, 377, 260, 362
See application file for complete search history.

(56) References Cited

U.S. PATENT DOCUMENTS

| | | | | |
|---|---|---|---|---|
| 736,304 | A * | 8/1903 | Scott | 403/7 |
| 1,557,156 | A | 10/1925 | Gless | |
| 1,613,360 | A | 1/1927 | Rigby | |
| 1,634,887 | A | 7/1927 | Rigby | |
| 1,638,454 | A | 8/1927 | Papin | |
| 1,895,369 | A | 1/1933 | Blatz | |
| 1,967,355 | A | 7/1934 | Edwards | |
| 2,092,839 | A | 9/1937 | Gouverneur | |
| 2,131,966 | A | 10/1938 | Nelson | |
| 2,348,727 | A * | 5/1944 | Cote | 408/142 |
| D173,995 | S | 2/1955 | Olsen | |
| 2,801,106 | A | 7/1957 | Koehler | |
| 3,102,726 | A | 9/1963 | Barrett | |
| 3,245,686 | A | 4/1966 | Hartmeister | |
| 3,476,349 | A * | 11/1969 | Smith | 248/476 |
| 3,516,697 | A | 6/1970 | Hahn | |
| 3,539,185 | A | 11/1970 | Andis | |
| 3,834,714 | A | 9/1974 | Smolinski | |
| 3,837,647 | A | 9/1974 | Jacques | |
| D251,311 | S | 3/1979 | Jackson | |
| 4,491,323 | A | 1/1985 | Kozub | |
| D280,119 | S | 8/1985 | McRae | |
| 5,024,438 | A | 6/1991 | Candow | |
| 5,127,650 | A | 7/1992 | Schneller | |
| 5,282,619 | A | 2/1994 | Napolitano et al. | |
| 5,390,921 | A | 2/1995 | De Ruyter | |
| D359,541 | S | 6/1995 | Lamanna | |
| 5,423,536 | A | 6/1995 | Brown | |
| D370,953 | S | 6/1996 | Visalli | |
| 5,569,096 | A | 10/1996 | Lee | |
| 5,649,870 | A | 7/1997 | Harrison | |
| 5,976,031 | A | 11/1999 | Johnson | |
| 5,997,412 | A | 12/1999 | Benson | |
| 6,196,930 | B1 | 3/2001 | Aumock | |
| 6,213,890 | B1 | 4/2001 | Prince | |
| 6,283,874 | B1 | 9/2001 | Studebaker | |
| D449,665 | S | 10/2001 | Etherton et al. | |
| 6,299,180 | B1 * | 10/2001 | Satran et al. | 279/83 |
| 6,558,269 | B1 | 5/2003 | McBee | |
| 2002/0044822 | A1 * | 4/2002 | Grimmel | 403/362 |
| 2002/0091012 | A1 | 7/2002 | Evans | |
| 2002/0111227 | A1 | 8/2002 | Wilson | |
| 2003/0050131 | A1 | 3/2003 | Grace | |
| 2003/0083144 | A1 | 5/2003 | Shin | |

* cited by examiner

*Primary Examiner*—Stephen L. Blau
(74) *Attorney, Agent, or Firm*—John P. McGonagle

(57) ABSTRACT

A belly putter incorporating an adjustable shaft length feature. The adjustable length shaft feature may be added to an existing standard putter or may be incorporated into a specifically built belly putter. A rounded top to the belly putter shaft with completely curved and rounded sides is also provided.

2 Claims, 4 Drawing Sheets

ADJUSTABLE LENGTH BELLY PUTTER

BACKGROUND OF THE INVENTION

This invention relates to golf putters and, in particular, to a belly putter with an adjustable length shaft.

One of the most difficult problems with putting is to attain a pendulum swinging motion with the putter club through the ball striking area. It is difficult to stabilize and hold steady the top of the putter club. Movement of the club along the putter club shaft longitudinal axis is one of the most frequent causes of putter miss hits. However, it has been observed that when a golfer is holding a regular putter in position to strike a golf ball, a hypothetically extended longitudinal axis of the putter club shaft will meet the golfer near to the golfer's belly button. Experiments with putter club shafts have led to the mid-length putter or belly putter. The belly putter shaft is longitudinally extended so that it terminates at the golfer's stomach. This stabilizes the top of the putter club shaft eliminating movement along the putter club shaft longitudinal axis, thereby eliminating the cause of a high proportion of putting miss hits. The golfer's arms and hands, as well as the angle of the putter shaft to the ball, are exactly the same as with a regular putter. The belly putter enables the golfer to attain a substantially improved pendulum swinging action when striking the golf ball. Although there are substantial advantages to a belly putter, there are draw backs.

Golf clubs generally allow a golfer to adjust his or her stance by approximately five inches, i.e., the club grip is approximately five inches longer than a golfer's grip. Therefore, a golfer can change his or her stance from fairly upright to fairly bent over merely by moving his or her hands up or down the club grip. Putter club grips are generally approximately twelve inches long and a normal golfer grip could be six to seven inches long. Club grips for woods and irons are slightly longer, and the golfer grips slightly less. All putter clubs, except one, provide a golfer with the ability to adjust to changes in stance and putting style. The exception is the belly putter, also known as the mid-length putter.

A belly putter shaft length is critical. Regardless of where the club shaft is gripped by the golfer, the pendulum fixed point is the golfer's stomach and this cannot be changed by the golfer's grip position. Currently, belly putters are offered for sale only at certain finite standard shaft lengths, i.e., forty-one inches, forty-three inches and forty-five inches. Unfortunately, these lengths will only accommodate a small percentage of golfers. Factors such as girth, height, arm length, frame, etc. all contribute to an ideal shaft length. Even a difference of an eighth of an inch is important to fitting a belly putter to a golfer. A golfer five feet tall would most likely require a shaft length in the range of thirty-six inches. A golfer six feet four inches tall would require a shaft in the range of forty-seven inches. In many cases, the same golfer may require a varying shaft length over the course of a season. If a manufacturer made a full range of belly putter lengths, at one-quarter inch increments, it would require forty-six belly putter models for each different putter style to be kept in stock at each retail store. This is simply not practical for the manufacturer or the many retail outlets.

Even if the manufacturer made a wide range of belly putter shaft lengths, the problem would not be solved. The fixed length of a belly putter does not allow changes in the golfer's stance. Golfers continuously experiment with their putting styles, usually involving a change in stance. Feet may be moved closer or farther apart from each other. The golfer may move closer or farther from the ball. The golfer may stand more upright or crouch further down. The golfer may lose or gain five or ten pounds. All of these factors significantly change the "ideal" shaft length of the belly putter.

Another problem with belly putters is the putter top which forms the pendulum fixed point with the golfer's stomach. All conventional putters today have a normal putter grip top. The normal putter grip top is round or oblong with a slightly crowned top. The top is almost flat and has a relatively hard perimeter edge. Conventional belly putter tops have the same or similar tops. This is a drawback because the conventional top does not provide a smooth, continuous rolling effect against the golfer's stomach as the putter is swung in a pendulum motion from the back stroke through the ball. When the golfer attempts to move the putter through a pendulum stroke, one edge of the putter top digs into the golfer's stomach and then suddenly releases. The top of the putter shaft must then be rolled firmly to overcome the resistance of the top opposite edge. The conventional putter top essentially snags the golfer's stomach.

SUMMARY OF THE INVENTION

The present invention provides a belly putter which overcomes the above described drawbacks while providing the full advantages of the belly putter concept. The present invention provides a golfer with a belly putter having a perfect fit. Furthermore, the belly putter of the present invention provides a putter which allows the golfer to make various stance and style adjustments on a regular basis without replacing the putter. The belly putter of the present invention provides this by incorporating an adjustable shaft length feature into the belly putter. The adjustable length shaft feature may be added to an existing standard putter or may be incorporated into a specifically built belly putter. The present invention also provides a rounded top to the belly putter shaft with completely curved and rounded sides. Conventional hard edges are eliminated.

These, together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
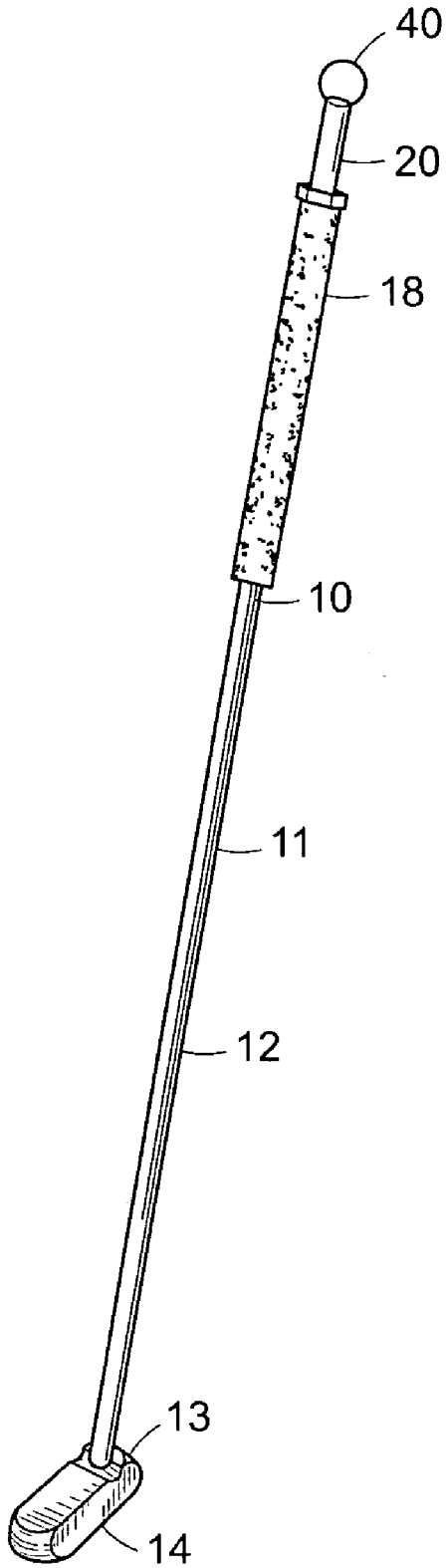
FIG. 1 is a perspective view of an adjustable length belly putter.
Figure 4:
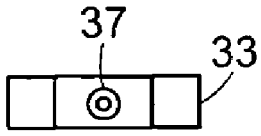
FIG. 4 is a side view of a shaft collar.
Figure 3:
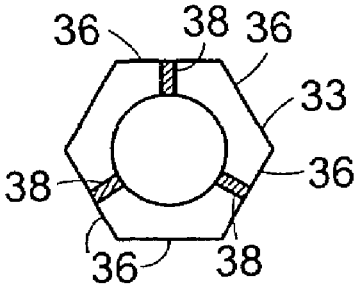
FIG. 3 is a top view of a shaft collar.
Figure 2:
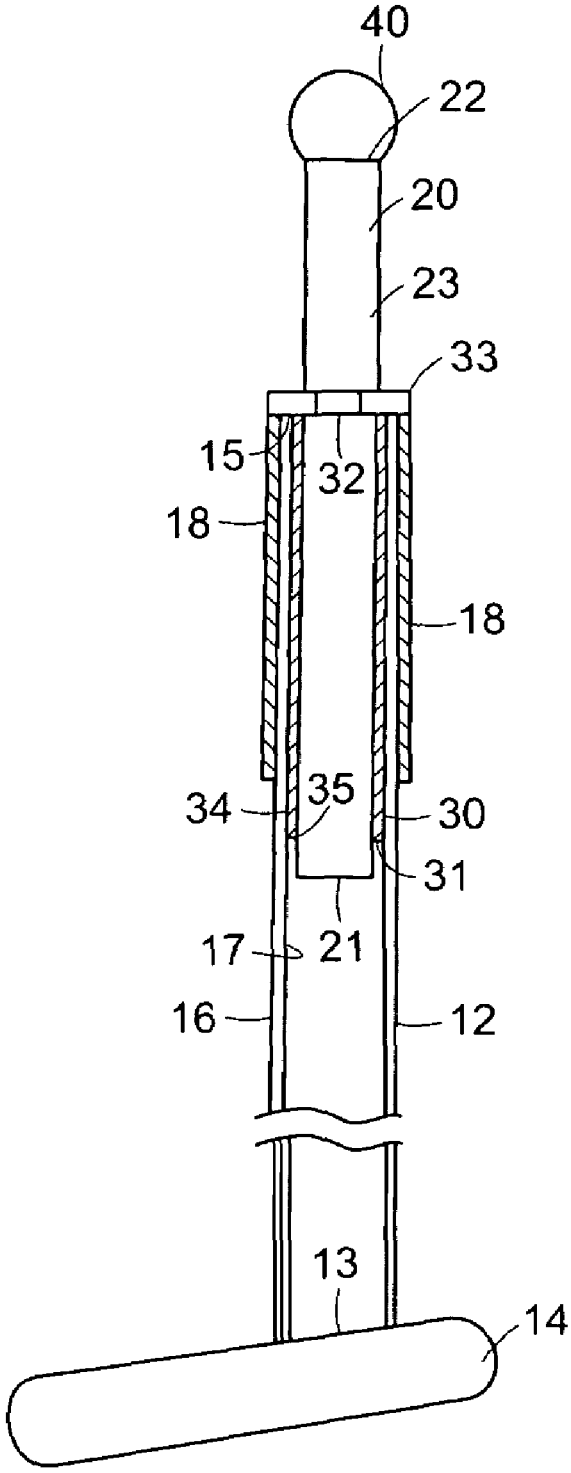
FIG. 2 is a sectional view of the putter of FIG. 1.
Figure 5:
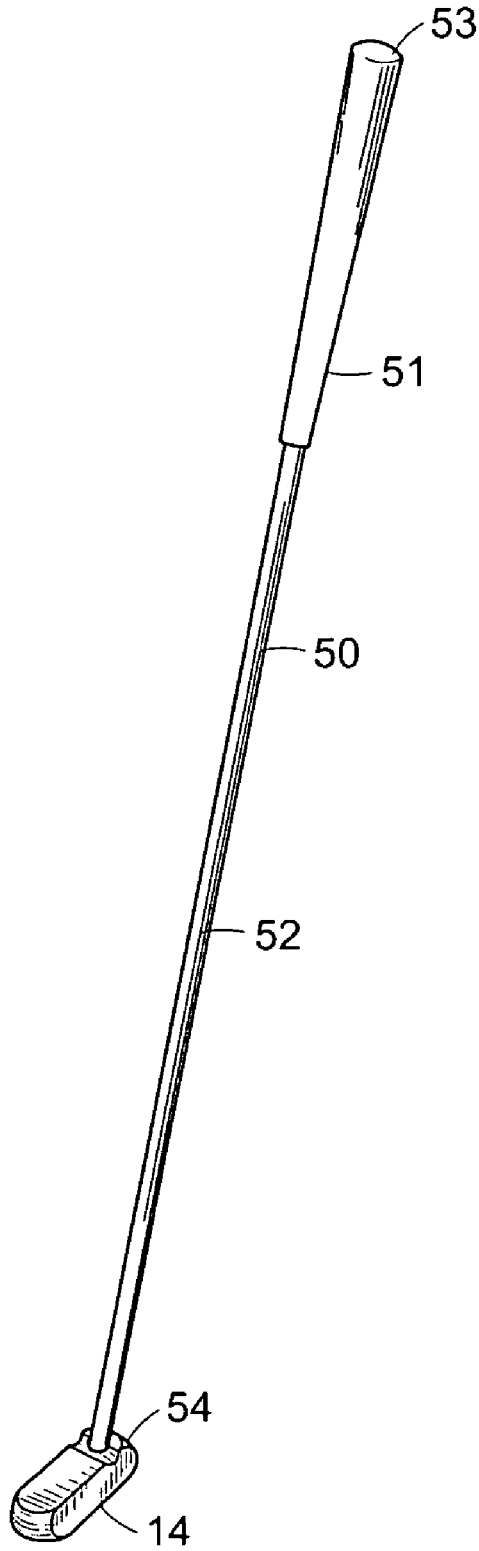
FIG. 5 is a perspective view of a conventional putter.
Figure 6:
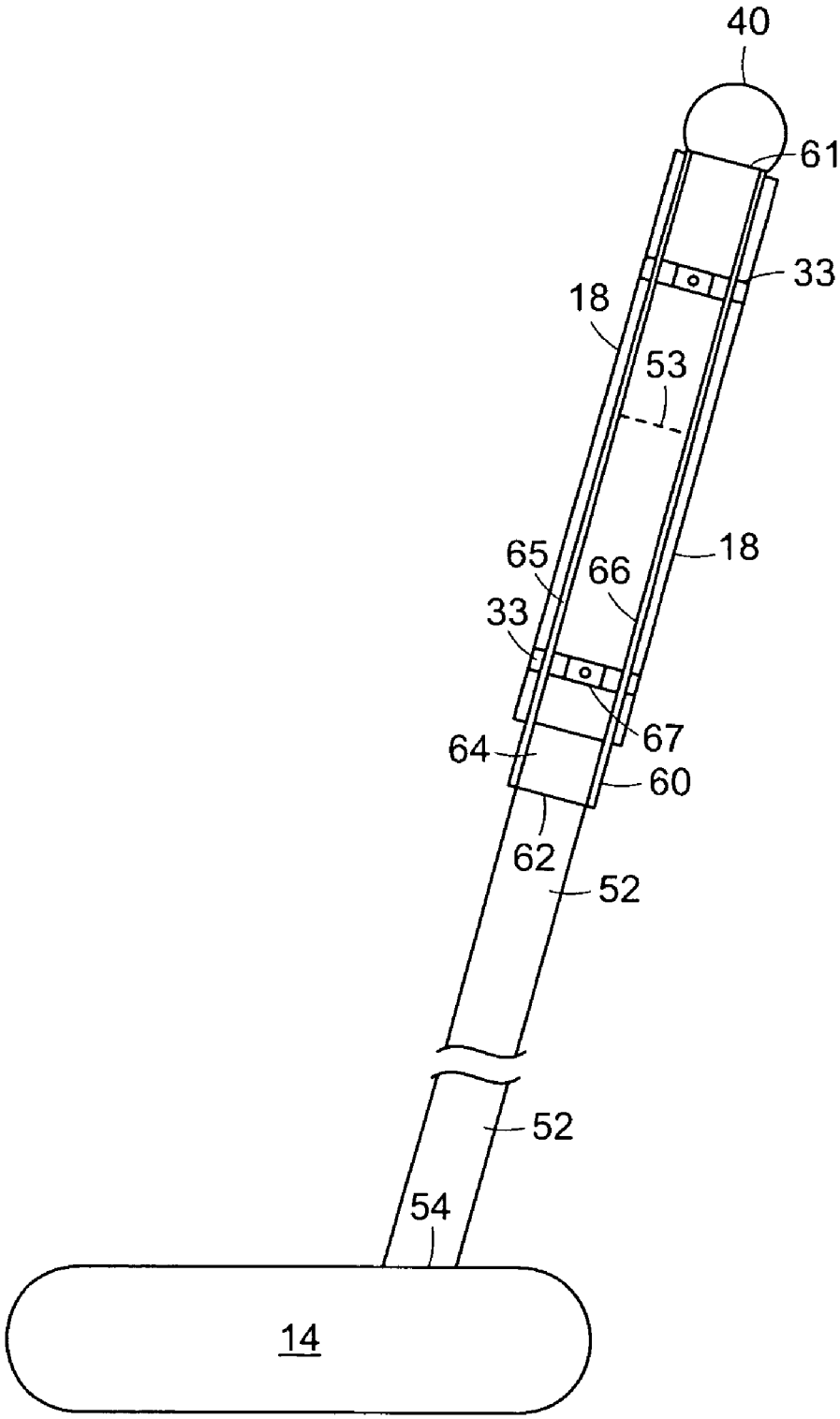
FIG. 6 is a sectional view of a modified conventional putter.

Referring to the drawings in detail wherein like elements are indicated by like numerals, there is shown a belly putter 10 constructed according to the principles of the present invention. The putter 10 has an elongated shaft 11 comprised of a hollow lower section 12 and an upper section 20. The shaft lower section 12 has two ends, an open top end 15 and a bottom end 13 terminating in a putter head 14. The shaft lower section 12 has an exterior surface 16 and an interior surface 17. The shaft upper section 20 has an open bottom end 21, an upper end 22 terminating in a putter top 40, and an exterior surface 23. The shaft upper section 20 may be a cylindrical tube or a cylindrical rod. In other embodiments of the invention, the shaft upper section 20 could have a hexagonal cross section or other cross sectional shape.

The putter 10 is further comprised of a hollow sleeve insert 30 having an open bottom end 31, a top end 32 terminating in a collar 33, an exterior surface 34 and an interior surface 35. The insert 30 is permanently fitted into the shaft lower section 12 whereby the insert exterior surface 34 engages the lower section interior surface 17, and the insert collar 33 rests on and is attached to the lower section top end 15. The shaft upper section 20 is inserted into the insert 30 whereby the upper section exterior surface 23 engages the insert interior surface 35. The sleeve insert 30 has cross sectional shape corresponding to the cross sectional shape of the shaft upper section 20. The insert collar 33 has a hexagonal shape with six sides 36, every other side having a threaded aperture 37 formed therein, each threaded aperture 37 having a dog point (non-backout), self-locking set screw 38 inserted therein, each set screw adapted to being manipulated by an allen wrench. Each set screw 38 is adapted to being tightened against the shaft upper section external surface 23 thereby holding the shaft upper section 20 in a desired vertical position.

The shaft lower section 12 may have a conventional gripping surface 18 attached about the lower section exterior surface 16 and terminating at the lower section top end 15. As stated above the shaft upper section 20 has an upper end 22 terminating in a putter top 40. The prior art putter top is replaced with a spherical top. The spherical top may be slightly flattened while still having completely curved and rounded sides. The putter top 40 would preferably be made of a non-skidding and resilient material. The diameter of the putter top 40 would be in conformity with golfing rules which presently calls for a maximum grip diameter of 1¾ inches.

It may be desirable to modify an existing conventional putter 50 and convert it into a belly putter. This is done by removing the conventional grip 51 from the putter shaft 52, said putter shaft having a top end 53 and a bottom end 54 terminating in a putter head 14. A hollow tube 60 having a top end 61, a bottom end 62, and a cylindrical wall 64 having an exterior surface 65 and an interior surface 66 is placed over said putter shaft top end 53. The hollow tube top end 61 terminates in a spherical top 40. The hollow tube has two collars 33 formed on said wall 64. The collars are approximately twelve inches apart. Each collar 33 has a hexagonal shape with six sides 36, every other side having a threaded aperture 37 formed therein, each threaded aperture 37 having a dog point (non-backout), self-locking set screw 38 inserted therein, each set screw adapted to being manipulated by an allen wrench. The wall 64 has six apertures 67 formed therein, each said aperture 67 corresponding to a collar aperture 37. Each set screw 38 is adapted to being tightened through a wall aperture 67 against the putter shaft 52 thereby holding the tube 60 in a desired vertical position and centered on the putter shaft 52. A gripping surface 18 would be attached about the tube exterior surface 65. By having two collars 33 putters with shaped or stepped shafts may be modified. In other embodiments of the invention the hollow tube 60 may have a cross sectional shape other than a cylinder, e.g., hexagonal.

It is understood that the above-described embodiment is merely illustrative of the application. Other embodiments may be readily devised by those skilled in the art which will embody the principles of the invention and fall within the spirit and scope thereof.

I claim:

1. A belly putter comprising:

a putter shaft with a top end and a bottom end terminating in a putter head;

a hollow tube having a top end, a bottom end, a bottom portion, and a cylindrical wall having an exterior surface and an interior surface placed over said putter shaft top end, said hollow tube top end terminates in a spherical top, said hollow tube has two collars formed on said wall, each said collar having a hexagonal shape with six sides, every other side having a threaded aperture formed therein, each threaded aperture having a dog point, self-locking set screw inserted therein, said wall having six apertures formed therein, each said aperture corresponding to a collar aperture, each set screw adapted to being tightened through a wall aperture against the putter shaft thereby holding the tube in a desired vertical position.

2. A putter as recited in claim 1, further comprising:

a gripping surface attached about the tube exterior surface.

* * * * *